252-99 AU 166 EX
5/9/78 4,088,595

United States Patent [19]
Michelson et al.
[11] 4,088,595
[45] May 9, 1978

[54] DETERGENT COMPOSITION COMPRISING A SYSTEM PRODUCING SUPEROXIDE IONS

[75] Inventors: Adolf Michael Michelson, Chatenay-Malabry; Philippe Rotter, Noisy-le-Roi, both of France

[73] Assignee: Agence Nationale de Valorisation de la Recherche (ANVAR), Neuilly-sur-Seine, France

[21] Appl. No.: 712,329

[22] Filed: Aug. 6, 1976

Related U.S. Application Data

[63] Continuation of Ser. No. 533,640, Dec. 17, 1974, abandoned.

[30] Foreign Application Priority Data

Dec. 21, 1973 France ..... 73 45987

[51] Int. Cl.[2] ..... C11D 3/395; C11D 7/54

[52] U.S. Cl. ..... 252/95; 252/89 R; 252/99; 252/102; 252/105; 252/DIG. 12; 8/111

[58] Field of Search ..... 252/95, 99, 89, DIG. 12, 252/102, 105; 8/111

[56] References Cited

U.S. PATENT DOCUMENTS 3,969,387 7/1976 Merkl ..... 260/448

*Primary Examiner*—Mayer Weinblatt
*Attorney, Agent, or Firm*—Hammond & Littell

[57] ABSTRACT

The invention relates to an improved detergent composition. This composition comprises at least one hydrosoluble salt of a metal selected from the group consisting of divalent iron, divalent cobalt and divalent nickel, associated with at least one hydrosoluble ligand which is a hydrogen donor and has at least two sites available for fixing to the said metal.

Application to all cleaning, and preferably to laundry and dishwashing.

9 Claims, No Drawings

DETERGENT COMPOSITION COMPRISING A SYSTEM PRODUCING SUPEROXIDE IONS

PRIOR APPLICATION

This application is a continuation of our own copending application Ser. No. 533,640 filed Dec. 17, 1974, now abandoned.

The present invention relates to an improved detergent composition and the process for obtaining same.

The invention relates more particularly to a detergent composition comprising a system producing superoxide ions and a process for obtaining such a composition.

The production of superoxide radicals or ions as intermediates in many enzymic reactions occuring under oxidizing conditions and involving molecular oxygen is already known; thus, in J. Biol. Chem, 243, 5733 (1968), the formation of superoxide radicals during oxidation of hypoxanthine with xanthine oxidase was described.

The production of superoxide ions by the electrolytic reduction of oxygen and with subsequent stabilization of the radicals produced by dissolving them in dimethylformamide has also already been described (J. Biol. Chem., 244,6049 (1969)).

The production of superoxide ions by oxidation of hydrogen peroxide with sodium periodate has also been described in Biochem. J. 111, 53 (1969), the production of superoxide ions then being proved by means of a technique described in the above-mentioned article and using electron spin resonance techniques.

Finally, in Biochimie, 55, 4(1973), pp. 465–479 and Biochimie, 55, 8 (1973) pp. 925–942, it was shown that superoxide ions can be obtained by chemical means, by the reduction of dissolved molecular oxygen catalyzed with metal ions.

It has been found possible to produce improved detergent compositions by incorporating a suitable superoxide ion forming system in soaps or synthetic granular detergent composition.

The primary object of the present invention is a detergent comprising soap or synthetic granular detergents, further comprising as a system forming superoxide ions, a water soluble salt of a metal selected from the group consisting of divalent iron, divalent cobalt and divalent nickel, associated with at least one water soluble ligand which is a hydrogen donor and having at least two sites available for fixing to the said metal.

In another aspect, the invention relates to a detergent composition containing soap or granular synthetic detergents, comprising a water-soluble salt of a metal selected from the group consisting of divalent iron, divalent cobalt and divalent nickel, and a molar amount of 1 to 10 times that of the divalent metal ions, of at least one ligand which is a hydrogen donor and having at least two sites available for fixing to the said metal.

The ligands of the metal element included in the detergent composition of the invention are selected from water-soluble compounds which are hydrogen donors and having at least two sites available for fixing to the said metal.

Examples of ligands complying with this definition are hydrosoluble organic compounds having one or more —$NH_2$ and/or —COOH groups in their molecule, and more particularly polypeptides, oligopeptides such as for example tetraglycine, fumaric acid and salts or derivatives of the latter.

The ligands are preferably incorporated in excess in the composition of the invention and in the amount, in moles of ligand, of 1 to 10 times the amount of the divalent metal ions present.

It was surprisingly found that, when a suitable amount of a system comprising an aqueous solution of metal ions selected from the group consisting of $Fe^{2+}$, $Co^{2+}$ and $Ni^{2+}$ and, associated with the said metal ions, at least one ligand such as defined hereinabove at a rate of 1 to 10 moles of ligand per divalent metal ion, is incorporated in a soap or granular synthetic detergent, as soon as the said soap or granular synthetic detergent in the presence of a sufficient amount of water, continuous production of $H_2O_2$ superoxide ions is obtained, with the cooperation of the oxygen dissolved in the water, which is then reduced with catalysis.

The improved detergent compositions of the invention can, consequently be free of the components conventionally introduced into detergent compositions to produce hydrogen peroxide $H_2O_2$, such as perborates, percarbonates, peracids and the like.

This, in fact, is one of the most important advantages of the compositions of the invention, compared with those known and used up to now.

As an example, studying the luminol oxidation curves obtained as described in Biochimie, 55, No. 4 (1973) pp. 465–479, it was established that the oxidizing activity of the superoxide ions $O_2$ produced by the system described above of detergent compositions of the invention, is at least higher than that of $H_2O_2$ by a factor $10^4$.

Although it is impossible to specify the amount of the superoxide ion producing system to be used per weight unit of soap or detergent, it is clear from the above description, that one with ordinary skill in the art is able to determine for each practical case the amounts of hydrosoluble metal salt and hydrosoluble ligand such as defined, which should be incorporated in the soap or granular detergent to which it is to be added. The amount of the superoxide ion producing system is not critical and it is within the capacity of one with ordinary skill in the art to determine the most suitable amount in each case, this depending of the result desired.

Typically a minimum amount of about 1 g of ligand and about 15 mg hydrosoluble metal salt per kilogram of detergent is allowed for, this conforming with the amount of the perborate, percarbonate or peracid type oxidizing component most commonly used in conventional detergent compositions, such an amount enabling releasing $10^{-5}$ to $2 \times 10^{-}$M hydrogen peroxide.

More precisely, it is now considered that the maximum amount of superoxide ion producing system to be used corresponds to an amount such that there is $10^{-4}$ mole ligand and $10^{-5}$ mole hydrosoluble metal salt per liter of aqueous cleaning solution made from the soap or granular synthetic detergent used.

In principle, any soaps or granular detergents can be used in the invention and can be selected from those now commercially available or described in the literature; preferably, however, they do not contain phosphates or polyphoshates and can even contain no oxidizing agents such as perborates, percarbonates and peracids, among others.

Provided that the composition of the basic detergent system and the pH are suitable, the improved detergent compositions of the invention are suited for washing clothes, as heavy duty detergent or as light duty detergent and also for dish washing, by hand or in automatic machines, and even for any other forms of cleaning.

The improved detergent compositions of the invention can also be used for bleaching paper.

The compositions of the invention can comprise at least one builder, such as a polyanionic and alkaline, organic or mineral, salt such as a borate, a carbonate, a poly- or tripolyphosphate, a sodium or potassium silicate, or a water soluble polyphosphonate, a water soluble polycarboxylate, a water soluble amino-polyacetate, or the like. However, as has been mentioned above, it is advantageous for the detergent composition, whether soapy or not, to be free of perborates, percarbonates and/or peracids and the salts thereof, the superoxide ion producing system of the invention making it possible to obtain still better results, without possessing the drawbacks of these prior art additives.

The basic detergent of the improved detergent compositions of the invention can be a soap or a non-soapy synthetic detergent, such as an anionic, cationic, nonionic, ampholytic or zwitterionic detergent or a mixture of such detergents.

The detergent compositions for laundry preferably have a pH of about 7 to 12 when dissolved at a concentration of 0.1 to 0.2% by weight in water.

A further object of the invention is a process for cleaning and removing soil in general from any material, the said process consisting in washing the material to be cleaned in an aqueous bath containing, for example, a detergent composition such as defined hereinabove at a rate of about 0.5% by weight.

The exceptionally good results provided by the detergent compositions of the invention are thought to be due to the fact that the ligand + hydrosoluble metal salt system has the effect not only of providing $O_2^{\mp}$ ions which are an extremely reactive oxidant, but also free radicals of the ligand (s) used; now, said free radicals can attack aromatic compounds and thus solubilize certain stains or soils which are among the most resistant to cleaning.

Furthermore, in an aqueous solution, the improved detergent compositions of this invention initiate the continuous production of superoxide ions and hydrogen peroxide, by catalytic reduction of the molecular oxygen naturally present in the dissolved state in the water used. It has been proved that both superoxide ions $O_2^{\mp}$ and hydrogen peroxide $H_2O_2$ are produced by adding to the reaction system either superoxide dismutase or catalase, which both inhibited oxidation of luminol selected as oxidation reaction model and followed by measurement of the light emission. One could thus believe, while in no way limiting the scope of the invention by this theoretical explanation, that the production of superoxide ions in the detergent compositions of the invention is due to the mechanism of electron reduction of oxygen, the divalent metal ion ligands having the effect of activating said reduction and constituting hydrogen donors, thus permitting continuous production of superoxide ions.

The production of superoxide ions is therefore self-perpetuating, which is a considerable and essential advantage. Said production starts as soon as the improved detergent composition of the invention is contacted with water, either by adding water to it, or by putting it in aqueous solution, even at a temperature as low as room temperature, preferably at about 20° C; said production of superoxide ions continues in time to reach a maximum generally after 1 minute; it then changes and is stabilized at a level representing, as the case may be, from 25 to 40% of said maximum, a level at which the production of superoxide ions continues for 20 minutes to 1 hour and even longer.

The most effective detergent compositions and most advantageous conditions for carrying out the process of the invention vary with the metal ion which is used; thus, with $Fe^{2+}$ for example, dihydroxyfumaric acid is much to be preferred to tetraglycine; with $Co^{2+}$, the superoxide ion production reaction develops slowly and lasts for a long time with dihydroxyfumaric acid as ligand, producing both $H_2O_2$ and $O_2^{\mp}$ at pH 9 and, on the other hand, becomes rapid at pH 9.8 with the same ligand and metal ion.

With $Co^{2+}$ and tetraglycine as ligand, the oxidation reaction is slow and continuous and principally $H_2O_2$ is formed, with a smaller proportion of $O_2^{\mp}$. The simultaneous presence of dihydroxyfumaric acid in said system displaces the balance in line with a preponderant production of $O_2^{\mp}$.

With $Ni^{2+}$ and dihydroxyfumaric acid, or a dihydroxyfumarate, a slow oxidation reaction develops, with a first rapid initial phase. It was possible to determine that this was due to the fact that an essentially continuous formation of superoxide ions occurs in this case, oxydation obtained by such a system is rapid at pH 9 but very slow at pH 9.8.

With $Ni^{2+}$ and tetraglycine as ligand, an optimum of between pH 9 and 10 is obtained for oxidation in response to the superoxide ions produced.

The improved detergent compositions of the invention can be soapy or non-soapy, and are useful for example in laundry, both for heavy duty and light duty, in paper making, for dishwashing, among others and, generally speaking, for all types of cleaning.

Said compositions can be prepared by any known process, consisting in mixing the components comprising soap or a granular detergent, previously obtained or during manufacture, with the ligand(s) + metal ion(s) according to the invention.

It should further be noted that it is also possible, without departing from the scope of the invention, to use any mixture, of at least two hydrosoluble salts of a metal selected from the group consisting of divalent iron, divalent cobalt and divalent nickel.

The invention is further illustrated by the following examples, which in no way limit it.

EXAMPLE 1

$3.0 \times 10^{-4}$M nickel sulphate, $3.0 \times 10^{-4}$M tetraglycine, and $1.0 \times 10^{-4}$M sodium dihydroxyfumarate were mixed with so-called Marseille's soap at a rate of 4.5 g soap per liter of water, the water having a hardness of 119–120 mg/liter.

The washing water had a pH of 7 to 10.

A sample of cotton fabric with normalized soiling EMPA 101 (provided by EMPA, Unterstrasse 11, 9001 St Gall — Switzerland) was immersed in this solution and left to soak at 20° C for 1 hour. Compared with an identical test without a metal salt or ligands, the fabric was practically clean after this simple soaking, followed by rinsing with tap water, drying and ironing, whereas the control sample, once rinsed, dried and ironed, still appeared dirty.

Identical results were obtained by replacing the sodium dihydroxyfumarate with ammonium dihydroxyfumarate.

EXAMPLE 2

A series of experiments was carried out as in example 1, but increasing the soaking time from 1 hour to 12 hours, the temperature of the aqueous bath always being 20° C and, for each time of soaking, carrying out two tests and two comparative blank tests with each of the following samples of stained fabric:

1. Bleached cotton, without optical brighteners, EMPA 302,
2. Cotton with standardized EMPA stains, EMPA 101
3. Cotton stained with blood, EMPA 111
4. Cotton stained with cocoa, EMPA 112
5. Cotton stained with blood, milk and Indian ink, EMPA 116
6. Cotton stained with sulphur black, EMPA 115
7. Unbleached cotton, EMPA 304
8. Cotton stained with red wine, EMPA 114

In all cases, and notably in the case of samples 1, 2, 4 and 5, the cleaning obtained in the soaking bath containing the improved detergent composition of the invention was very much better than that obtained with the control soapy bath, which was most often ineffective or non-existent.

EXAMPLE 3

A sample of each of the above fabrics 1 to 8 was introduced into a solution of 4.5 g Marseille's soap or household soap in 1 liter of water, each time in a different vessel.

One sample of each of fabrics 1 to 8 were put, respectively into other vessels and a solution of 4.5 g Marseille's soap or household soap in 1 liter of water was then added, followed by a solution of 4.5 mg ammonium dihydroxyfumarate in 5 ml water and a solution of 7.2 mg hexahydrated cobalt chloride in 5 ml water.

The vessels were agitated manually for 30 seconds and left to stand at 20° C for 1 hour.

The pH of the solutions was about 8 in both cases; the water used had a hardness of 119–120 mg/liter.

The fabric samples were then removed from the vessels, rinsed with tap water and then dried and ironed.

The samples bearing the numbers 3, 6, 7 and 8 were at least as clean after washing with the composition of the invention as after the control wash; samples 1, 2, 4 and 5 were markedly cleaner than the controls washed with soap.

EXAMPLE 4

The test was carried out as in example 3, but using 4.5 g of a synthetic detergent powder commercially available under the Trade Name "Paic" instead of the soap, and stirring the contents of the vessels by magnetic stirring at 20° C for 10 minutes, then leaving the said vessels to stand for 3 hours at 20° C; similar results were obtained as in example 3.

Identical washing results were obtained by using the following known detergent powders commercially available under the Trade Name "Lava", "Genie" and "Skip", instead of the above-mentioned detergent.

What I claim is:

1. A detergent composition consisting essentially of soap or granular synthetic detergents, and an amount sufficient to produce superoxide ions of at least one water soluble salt of a metal selected from the group consisting of divalent iron, divalent cobalt and divalent nickel, and an amount in moles of from 1 to 10 times that of the divalent metal ions of at least one water soluble ligand which is a hydrogen donor and has at least two sites available for fixing to the said metal selected from the group consisting of $—NH_2$ and —COOH and mixtures thereof.

2. A detergent compositon of claim 1 free of per compounds consisting essentially of soap, an amount sufficient to produce superoxide ions of at least one water soluble salt of a metal selected from the group consisting of divalent iron, divalent nickel and divalent cobalt and an amount in moles of from 1 to 10 times that of the divalent metal ions of at least one water soluble ligand which is a hydrogen donor and has at least two sites available for fixing to the said metal selected from the group consisting of $—NH_2$ and —COOH and mixtures thereof.

3. A detergent composition according to claim 1 wherein said ligand is selected from the group consisting of tetraglycine fumaric acid and dihydroxyfumanic acid and salts thereof.

4. A detergent composition according to claim 1 wherein the metal salt is a $Co^{2+}$ salt and the ligand is selected from the group consisting of dihydroxyfumaric acid, tetraglycine and a mixture thereof.

5. A detergent composition according to claim 1 wherein the metal salt is a $Ni^{2+}$ salt and the ligand is selected from the group consisting of dihydroxyfumaric acid, a sodium or ammonium dihydroxyfumarate, tetraglycine and a mixture thereof.

6. A process for cleaning and removing said from any material consisting in washing said material to be cleaned in an aqueous bath of about 0.5% by weight of a detergent composition of claim 1.

7. A detergent composition of claim 1 wherein the amount of said metal and ligand is capable of releasing $10^{-5}$ to $2\times10^{-3}$ m of superoxide ions.

8. A detergent composition of claim 1 which is free of per compounds.

9. A detergent composition of claim 8 containing soap.

* * * * *